US006032503A

United States Patent [19]

Grippe

[11] Patent Number: 6,032,503

[45] Date of Patent: Mar. 7, 2000

[54] METHOD AND APPARATUS FOR ROLL FORMING A PLURALITY OF HEAT EXCHANGER FIN STRIPS

[75] Inventor: Frank M. Grippe, Oak Creek, Wis.

[73] Assignee: Modine Manufacturing Company, Racine, Wis.

[21] Appl. No.: 09/197,825

[22] Filed: Nov. 23, 1998

[51] Int. Cl.[7] ..... B21D 13/00

[52] U.S. Cl. ..... 72/186

[58] Field of Search ..... 72/184, 185, 186, 72/196; 29/413

[56] References Cited

U.S. PATENT DOCUMENTS

| | | | |
|---|---|---|---|
| 4,170,122 | 10/1979 | Cowell | 72/186 |
| 4,297,866 | 11/1981 | Sakauye et al. | 72/186 |
| 4,888,972 | 12/1989 | Rouse | 72/186 |

*Primary Examiner*—Rodney Butler
*Attorney, Agent, or Firm*—Wood, Phillips, VanSanten, Clark & Mortimer

[57] ABSTRACT

A method and apparatus are provided for roll forming a plurality of fin strips (10) from a single elongated strip of sheet material (20). The strip (20) includes a pair of adjacent, longitudinal rows (22, 24) of alternating crests (26) and valleys (28), with the crests (26) and valleys (28) of the row (22) longitudinally offset from the crests (26) and valleys (28) of the other row (24) so that the two rows (22, 24) are joined by a plurality of longitudinally spaced discrete connections (30) that define a longitudinal interface (32) between the two rows (22, 24). The connections (30) are broken by displacing the two rows (22, 24) relative to each other to form a pair of fin strips (36, 38), with each fin strip (36, 38) having a side edge (40, 42) defined by the now separated interface (32).

13 Claims, 8 Drawing Sheets

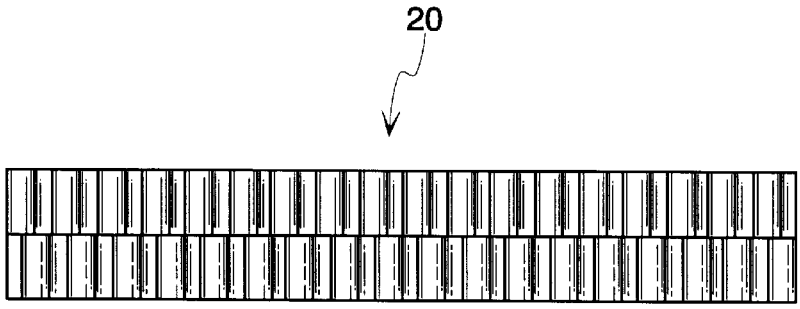
Fig. 8b
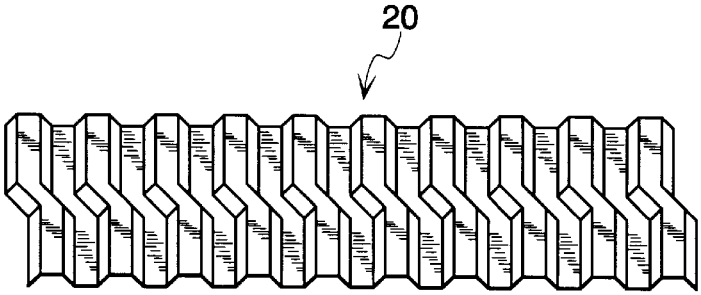
Fig. 8a
Fig. 6b
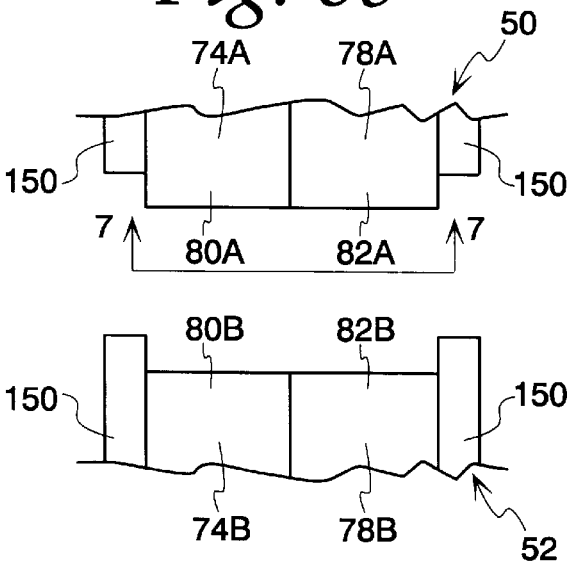
Fig. 7b
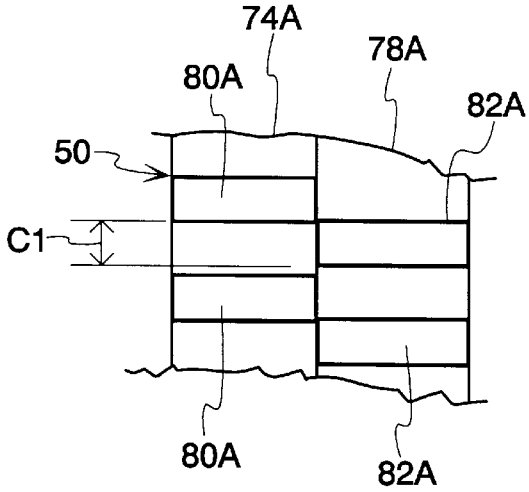

METHOD AND APPARATUS FOR ROLL FORMING A PLURALITY OF HEAT EXCHANGER FIN STRIPS

FIELD OF THE INVENTION

This invention relates to heat exchangers, and more particularly to methods and apparatus for forming fin strips that can be used to improve the heat transfer characteristics of heat exchangers.

BACKGROUND OF THE INVENTION

It is known to provide fin strips in heat exchangers to improve the heat transfer characteristics of the heat exchangers by providing additional heat conductive paths through periodic contact points with the walls of the heat exchange units or tubes of the heat exchangers. Fin strips may be provided on either the external side or the internal side, or both, of the heat exchange units or tubes of the heat exchanger. One common type of fin strips, sometimes referred to as turbulators, are provided inside the heat exchange units or tubes of heat exchangers to improve heat transfer characteristics of the heat exchangers. In general, such fin strips cause the fluid flowing through the heat exchange units to flow in a turbulent manner, thereby further enhancing the heat transfer characteristics of the heat exchanger. Examples of some fin strips are shown in U.S. Pat. Nos. 3,732,921 to Hillicki, et al.; 3,743,011 to Frost; 3,734,135 to Mosier; 3,763,930 to Frost; 4,360,055 to Frost; 4,561,494 to Frost; 4,967,835 to Lefeber, and 5,078,209 to Kerkman, et al.

Roll forming is one method commonly used to produce fin strips. Typically, a length of sheet stock having an initial width is run through a roll forming machine to provide a fin strip having a desired width. The sheet stock can either be purchased on the open market pre-slit to the initial width, or can be purchased at a wider width and slit by the fin strip manufacturer to the initial width in a slitting station prior to the forming stations. This approach requires either: a) that a single strip of sheet stock be run through the roll forming machine at a time, which tends to limit the output of the roll forming machine; or b) that multiple ribbons of sheet stock are run in parallel through the roll forming machine, which increases the output of the roll forming machine, but requires extensive set-up time as each of the individual strips are threaded through the roll forming stations.

SUMMARY OF THE INVENTION

It is the principal object of the invention to provide a new and improved method and apparatus for roll forming a plurality of fin strips from a single elongated strip of sheet material.

This objective is met in a method including the steps of providing an elongated strip of sheet material having a length and a transverse width; roll forming a pair of adjacent, longitudinal rows of alternating crests and valleys in the elongated strip of sheet material, the crests and valleys of one row of the pair being longitudinally offset from the crests and valleys of the other row of said pair so that the two rows are joined by a plurality of longitudinally spaced, discrete connections that define a longitudinal interface between the two rows; and breaking the connections by displacing the two rows relative to each other to form a pair of fin strips, each fin strip having a side edge defined by the now separated interface.

According to one facet of the invention, the rows are displaced in a direction that is mutually transverse to both the length and the transverse width during the breaking step.

According to another facet of the invention, the breaking step includes providing two pairs of mating roll die disks. Each pair has one disk mounted for rotation about a first axis and the other disk mounted for rotation about a second axis. One of the pairs engages one of the two Tows of alternating crests and valleys and forces the one row along a first path. The other of the pairs engages the other of the two rows and forces the other row along a second path that is displaced from the first path in the displacement direction.

According to another facet of the invention, the rows are displaced in a direction that is substantially parallel to the length of the strip during the breaking step.

According to one facet of the invention, the breaking step includes engaging the crests and valleys of the strip at a first location along the length of the strip with a first pair of mating roll dies, engaging the crests and valleys of the elongated strip at a second location along the length of the strip with a second pair of mating roll dies, the second location spaced from the first location along the length of the strip, and placing the elongated strip in tension between the first and second roll dies to displace the two rolls relative to each other in a direction that is substantially parallel to the length of the strip to break the connections.

According to one facet of the invention, a pair of mating roll dies are provided for forming a plurality of fin strips from a single elongated strip of sheet material that includes a pair of adjacent, longitudinal rows of alternating crests and valleys, with the crests and valleys of one row of the pair longitudinally offset from the crests and valleys of the other row of the pair so that the two rows are joined by a plurality of longitudinally spaced, discrete connections. The roll dies include first, second, third, and fourth toothed disks.

According to one form of the invention, the first toothed disk has a major diameter D1 and a minor diameter d1, and is mounted on one of the roll dies for rotation therewith about a first axis with the teeth of the first disk adapted to engage one of the two rows of alternating crests and valleys. The second toothed disk has a major diameter D2 and a minor diameter d2, and is mounted on the other of the roll dies for rotation therewith about a second axis with the teeth of the second disk adapted to engage the same row as the first toothed disk. The third toothed disk has a major diameter D3 and a minor diameter d3, and is mounted adjacent the first toothed disk on the same roll die as the first toothed disk for rotation therewith about the first axis with the teeth of the third disk adapted to engage the other of the two rows. The fourth toothed disk has a major diameter D4 and a minor diameter d4, and is mounted adjacent the second toothed disk on the same roll die as the second toothed disk for rotation therewith about the second axis with the teeth of the fourth disk adapted to engage the same row as the third toothed disk.

In one form of the invention, at least one of D2 and d2 is less than D1 or d1, respectively, and at least one of D3 and d3 is less than D1 or d1, respectively In one form, D2 is less than D1, d2 is less than d1, D3 is less than d1, and d3 is less than d1. The reliefs 140 have proven beneficial in minimizing excessive burring and other unacceptable defects in the side edges 40 and 42 of the fin strips 36 and 38, respectively.

According to one form of the invention, D4 is greater than D3, and d4 is greater than d3.

According to another form of the invention, D4 is nominally equal to D3, and d4 is nominally equal to d3.

According to one form of the invention, D1 is nominally equal to D4, d1 is nominally equal to d4, D2 is nominally equal to D3, and d2 is nominally equal to d3.

BRIEF DESCRIPTION OF THE DRAWINGS

FIG. 6B is a diagrammatic illustration similar to FIG. 6A, but showing a second embodiment of the first pair of roll dies;

FIG. 7B is a diagrammatic illustration taken generally along the line 7—7 in FIG. 6B showing the circumferential arrangement of a plurality of roll disks that make up one of the roll dies of the second embodiment;

FIG. 8A is a perspective view of the elongated strip of sheet material after being formed by the roll dies shown in FIGS. 6A and 7A;

FIG. 8B is a perspective view of the elongated strip of sheet material after being formed by the roll dies shown in FIGS. 6B and 7B;

DETAILED DESCRIPTION OF THE PREFERRED EMBODIMENT

Figure 1:
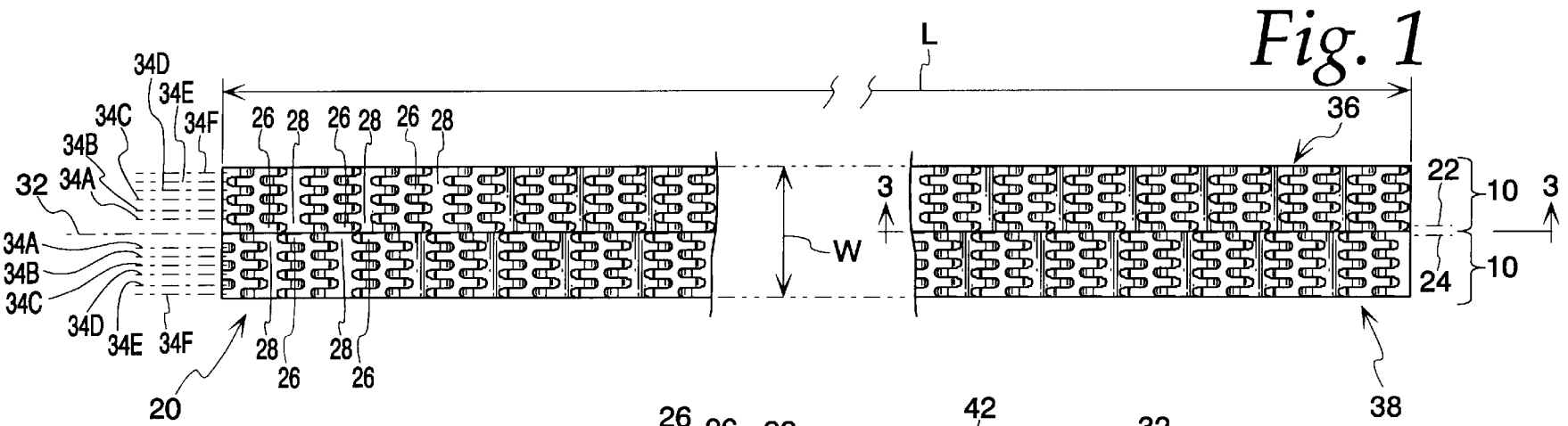
FIG. 1 is a perspective view of an elongate strip of sheet material from which a plurality of fin strips may be formed.

The exemplary embodiments of the invention are described herein and illustrated in the drawings in connection with a so-called "lanced and offset" fin strip.

However, it should be understood that the invention will find utility in other configuration of fin strips and that no limitation to use in connection with the particular configuration illustrated is intended except insofar as expressly stated in the appended claims.

Figure 2:
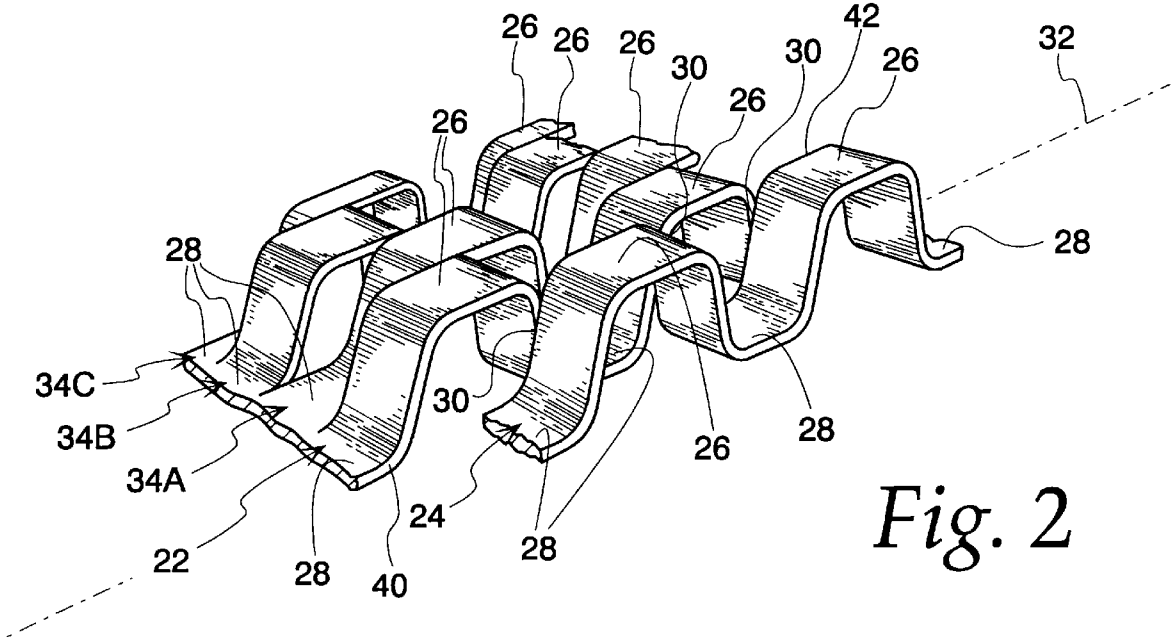
FIG. 2 is an enlarged, fragmentary view of a portion of the elongated strip of sheet material shown in FIG. 1.
Figure 3:
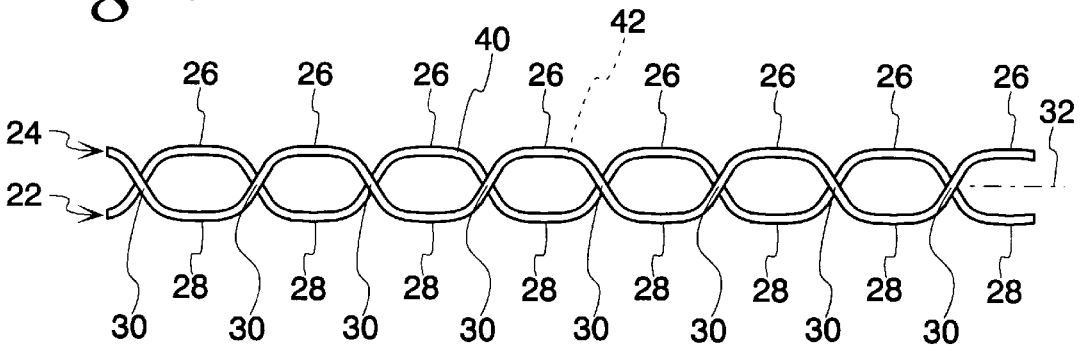
FIG. 3 is a section view taken along the line 3—3 in FIG. 1.

The invention is concerned with roll forming a plurality of fin strips 10 from a single elongated strip of sheet material 20 having a longitudinal length L and a transverse width W, as seen in FIG. 1. As best seen in FIGS. 2 and 3, the strip 20 includes a pair of adjacent, longitudinal rows 22 and 24 of alternating crests 26 and valleys 28, with the crests 26 and valleys 28 of the row 22 longitudinally offset from the crests 26 and valleys 28 of the other row 24 so that the two rows 22 and 24 are joined by a plurality of longitudinally spaced, discrete connections 30 that define a longitudinal interface, shown schematically by line 32, between the two rows 22, 24. As seen in FIGS. 1 and 2, for "lanced and offset" fin strips it is preferred that additional longitudinal rows 34A–34F of alternating crests 26 and valleys 28 be provided to each side of the pair of adjacent rows 22, 24 in the elongated strip of sheet material 20. While these additional rows 34A–34F provide one desired configuration for the fin strips 10 that will eventually be formed from the elongated strip of sheet material 20, it should be understood that some fin strips 10:

a) may require more of the additional rows 34A–34F, b) may not require any of the additional rows 34A–34F, c) may require that the crests 26 and valleys 28 of each of the rows 23, 24 extend across the entire width of each of the fin strips 10, or d) may require a different arrangement of additional rows for their desired configuration.

Accordingly, the additional rows 34A–34F are illustrative of only one option for a preferred embodiment of a fin strip, and the methods for forming the portions of the fin strips 10 other than the rows 22 and 24 are not the primary focus of the invention.

Figure 4:
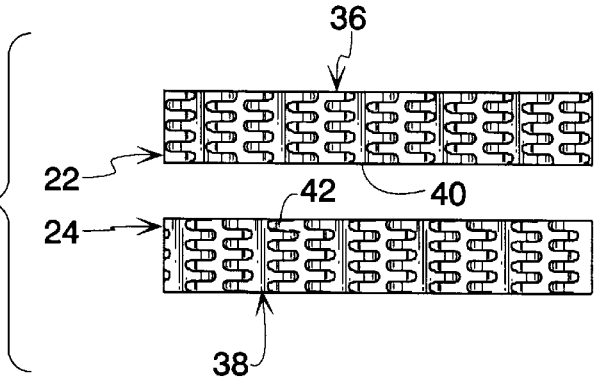
FIG. 4 is a perspective view of a pair of fin strips formed from the elongated strip of sheet material shown n FIG. 1.

The invention provides a unique and efficient method for separating the strip 20 of sheet material at the interface 32 to form a pair of fin strips 36 and 38, with each strip having a side edge 40 and 42 respectively, defined by the separated interface 32, as seen in FIG. 4.

Figure 5:
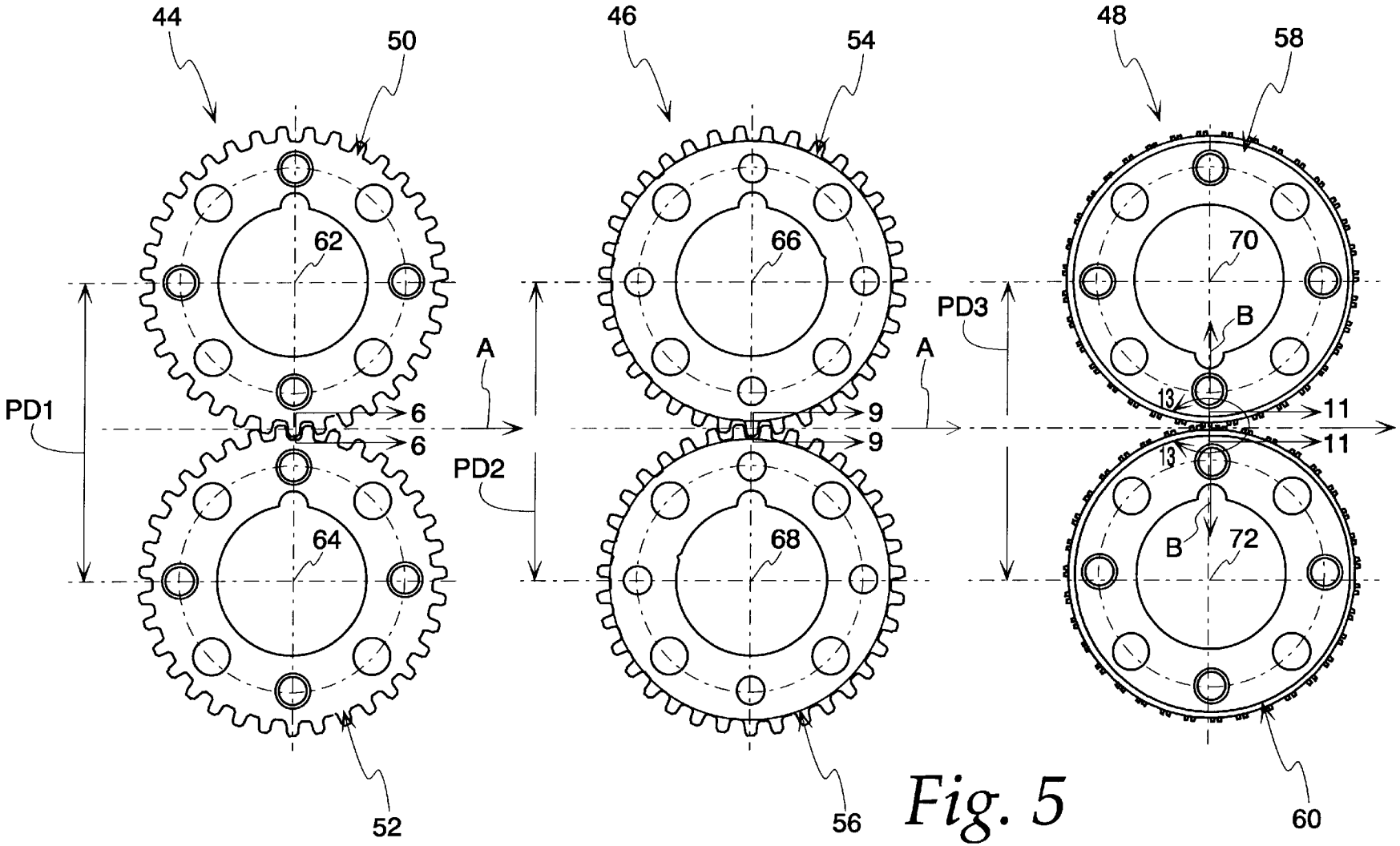
FIG. 5 is a diagrammatic representation of three roll forming stations and associated pairs of mating roll dies that may be used in performing the method of the invention.

The strip 20 can be formed by three roll forming stations 44, 46, and 48, such as shown diagrammatically in FIG. 5. Each of the roll stations 44, 46, 48 include respective pairs of toothed mating roll dies 50 and 52, 54 and 56, and 58 and 60, mounted for driven rotation about respective pairs of nominally parallel axes 62 and 64, 66 and 68, and 70 and 72. Each of the respective pairs of parallel axes 62 and 64, 66 and 68, and 70 and 72, are spaced apart by respective pitch diameters PD1, PD2, and PD3. As will be explained in more detail below, each of the roll dies 50–60 is formed by an axial stack of toothed roll die disks arranged with specific patterns of circumferential offset between the teeth of each of the disks to provide the desired roll formed configuration of the strip 20. The strip 20 travels through the roll stations 44, 46 and into the roll station 48 in a direction that is parallel to the length L of the strip, as indicated by arrows A, with the width W of the strip extending across the face width of the dies 50–60 (i.e., the width W extending parallel to the axes 62–72).

The roll dies 50–56 of the first two roll stations 44 and 46 form the pair of adjacent rows 22 and 24 in the strip of sheet material 20 using techniques that are essentially conventional and known for forming fin strips, and in particular lanced and offset fin strips.

In one embodiment of the invention, the roll dies 54 and 56 of the second roll station 46 cooperate with the roll dies 58 and 60 of the third station 48 to separate the strip of sheet material 20 into the individual fin strips 36 and 38 with the respective side edges 40 and 42 defined by the separated interface 32. More specifically, the roll dies 54, 56 and 58,60, cooperate to break the connections 30 by placing the strip of sheet material 20 in tension between the second and third roll stations 46, 48.

In another embodiment of the invention, the mating roll dies 58 and 60 of the third roll forming station 48 serve to separate the strip of sheet material 20 into the individual fin strips 36 and 38 with their respective side edges 40 and 42 defined by the separated interface 32. More specifically, the connections 30 are broken at the third station 48 by the dies 58,60 which displace the two rows 22, 24 relative to each other in a direction, indicated by arrows B, that is non-parallel to both the length L and the transverse width W of the strips of sheet material 20. In a preferred embodiment, the direction B is transverse to both the length L and width W.

In yet another embodiment, the roll dies 54 and 56 cooperate with each other to separate the strip of sheet material 20 into the individual fin strips 36 and 38. More specifically, the disks are configured so that the teeth of the mating roll dies 54 and 56 completely sever any connection between the two rows 22 and 24 at the interface 32, thereby forming the individual fin strips 36 and 38 with the respective side edges 40 and 42 defined by the separated interface 32, without forming the connections 30. This result can be achieved by adjusting the spacing PD2 between the axes 66 and 68 and by adjusting the amount of longitudinal offset between the rows 22 and 24.

Figure 6A:
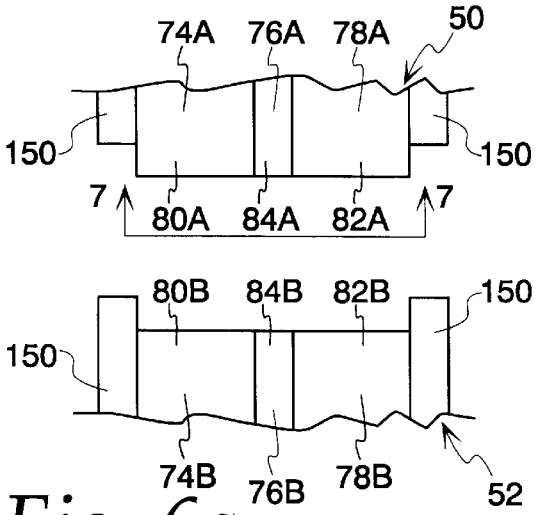
FIG. 6A is a diagrammatic illustration taken generally along the line 6—6 in FIG. 5 of the axial layout of a first embodiment of the first pair of the roll dies, with the dies separated for purposes of illustration.
Figure 7A:
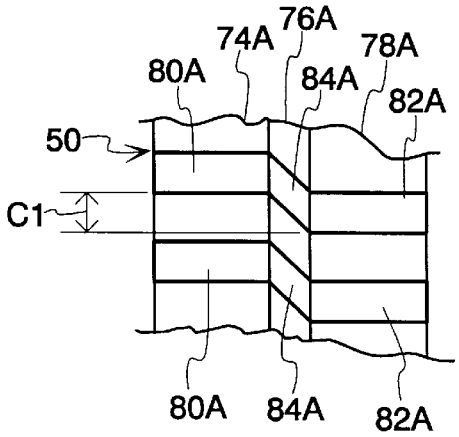
FIG. 7A is a diagrammatic illustration taken generally along the line 7—7 in FIG. 6A showing the circumferential arrangement of a plurality of roll disks that make up one of the roll dies of the first embodiment.

As best seen in FIG. 6A, in one embodiment each of the roll dies 50, 52 is made up of three toothed roll die disks 74A, 76A, 78A and 74B, 76B, 78B, respectively, mounted for rotation together about their respective axes 62 and 64, with the disk 74A mating with the disk 74B, the disk 76A mating with the disk 76B, and the disk 78A mating with the disk 78B. Because the relative circumferential arrangement of the teeth of the roll die disks 74A–78A is mirrored by the circumferential arrangement of the teeth of roll die disks 74B–78B, the circumferential arrangement need only be described in connection with the disks 74A–78A of the roll die 50. As seen in FIG. 7A, the disk 74A has a plurality of teeth 80A that are offset by a circumferential distance C1 from a plurality of teeth 82A on the disk 78A. The disk 76A has a plurality of teeth 84A that are formed at an angle to the respective axis 62 and 64 such that one end of each tooth 84A is circumferentially aligned with a tooth 80A of the disk 72A, and the other end of the tooth 84A is circumferentially aligned with a tooth of 82A of the disk 76A. The disks 74B–78B have a mirrored arrangement of teeth 80B–84B configured to extend into the tooth spaces between and mesh with the teeth 80A–84A, respectively. In this regard, it should be understood that if the teeth 84A are cut with a right-handed helix angle to the axes 62 and 64, the teeth 84B would be cut with a left-hand helix angle relative to the axes 62 and 64. Together, the disks 74A–78A and 74B–78B form the strip 20 into the configuration shown in FIG. 8A as the strip 20 is passed through the mating roll dies 50, 52.

As seen in FIGS. 6B and 7B, in another embodiment, the roll disks 76A and 76B have been eliminated from the roll dies 50 and 52 respectively, and the widths of the die disks 74A, 74B, and 78A, 78B have been extended to compensate for the width represented by the eliminated disks 76A, 76B. In all other aspects the embodiments shown in FIG. 6B and FIG. 7B are identical to the embodiments shown in FIG. 6A, 7A. Together, the disks 74A, 78A and 74B, 78B form the strip 20 into the configuration shown in FIG. 8B as the strip 20 is passed through the mating roll dies 50, 52.

It should be understood that the dies 50, 52 perform a performing step on the strip 20 that is not always required for all configurations of the final fin strips 36 and 38. For example, the illustrated pair of fin strips 36 and 38 can be formed according to the invention without using the dies 50, 52. However, the performing of the strip 20 provided by the dies 50, 52 can reduce the wear on the roll dies 54, 56 of the second roll station 46. Further, the performing provided by the dies 50, 52 can produce fin strips 20 having an improved accuracy in the configuration of the crests 26 and valleys 28.

Figure 9:
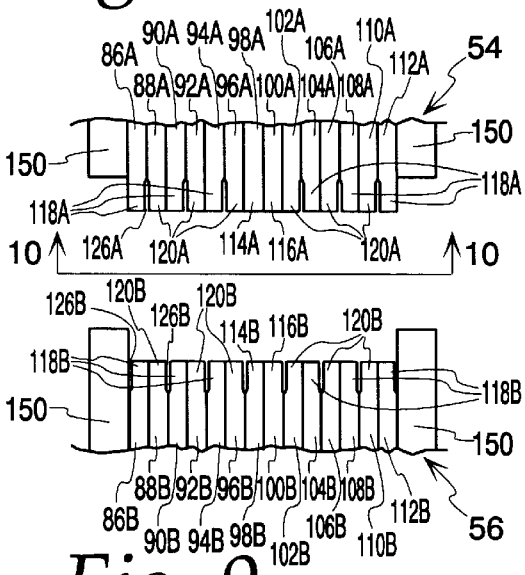
FIG. 9 is a diagrammatic illustration taken generally along the line 9—9 in FIG. 5 showing the axial layout of a second pair of the roll dies, with the dies separated for purposes of illustration.
Figure 10:
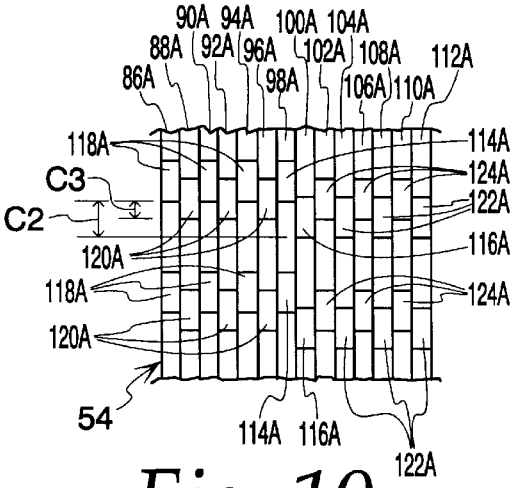
FIG. 10 is a diagrammatic illustration taken generally along the line 10—10 in FIG. 9 showing the circumferential arrangement of a plurality of disks that make up one of the roll dies shown in FIG. 9.

As seen in FIG. 9, each of the roll dies 54 and 56 is made up of 14 toothed roll die disks 86A, 88A, 90A, 92A, 94A, 96A, 98A, 100A, 102A, 104A, 106A, 108A, 110A, 112A and 86B, 88B, 90B, 92B, 94B, 96B, 98B, 100B, 102B, 104B, 106B, 108B, 110B, and 112B, respectively, mounted for driven rotation together about their respective axes 66 and 68, with the like numbered A-B pairs mating. Again, because the circumferential arrangement of the teeth of the disks 86A–112A is mirrored by the circumferential arrangement of the teeth of the disks 86B–112B, only the circumferential arrangement of the teeth of the disks 86A–112A of roll die 54 need be described in detail. As seen in FIG. 10, the disk 98A has a plurality of teeth 114A that are offset by the circumferential distance C2 from a plurality of teeth 116A on the disk 100A. The disks 98B and 100B have a mirrored arrangement of teeth 114B and 116B which extend into the tooth spaces between the teeth 114A and 116B, respectively, to mesh with the teeth 114A and 114B. When the strip 20 is passed through the teeth 114A–B and 116A–B, the disks 98A and 98B cooperate to form the row 22 of alternating crests 26 and valleys 28, while disks 100A and 100B cooperate to form the row 24 of alternating crests 26 and valleys 28. The circumferential offset C2 provides the longitudinal offset between the two rows 22 and 24 so that the rows are only connected by the discrete connections 30. Accordingly, the size of the connections 30 is dependent, at least in part, on the amount of circumferential offset C2. Additionally, the size of the connections 30 will also be dependent upon the configuration of the teeth 114A, 116A, and on the spacing PD2 between the axes 66 and 68.

Each of the disks 86A, 90A, and 94A have teeth 118A that are aligned circumferentially with the teeth 114A on the disk 98A, while the disks 88A, 92A, and 96A have teeth 120A that are offset by the circumferential distance C3 from the teeth 114A and 118A. Similarly, the disks 104A, 108A and 112A have teeth 122A that are aligned circumferentially with the teeth 116A on disk 100A, while disks 102A, 106A, and 110A have teeth 124A that are offset by the circumferential distance C3 from the teeth 114A and 122A. Again, the disks 86B–96B and 102B–112B have teeth 118B–124B that mirror the teeth 118A–124A to extend into the tooth spaces between the teeth 118A–124A, thereby meshing with the teeth 118A–124A. When the strip 20 is passed through the mating roll dies 54, 56, the disks 86A–96A and 102A–112A cooperate with the disks 86B–96B and 102B–112B, respectively, to form the optional, rows 34A–34F on each side of the rows 22 and 24. As noted above, the formation of the additional rows 34A–34F on each side of the rows 22 and 24 are not the primary focus of the invention. However, it should be noted that it has proven to be advantageous to provide reliefs 126A and 126B that extend peripherally about the entire radially outer end surfaces of the teeth 118A–118B, 120A–120B, 114B, and 116B in an alternating pattern as shown in FIG. 9 so that the interface between each of the rows 34A–34F are engaged either by the reliefs 126A, or by the reliefs 126B. The reliefs 126A, 126B enhance the stripping of the sheet material 20 from the roll dies 54, 56. The amount of relief is dependent on the nature of the sheet material and its thickness. It should be understood that it may also be desirable to provide such reliefs at the interfaces between the teeth 114A and 116A and between the teeth 114B and 116B.

Figure 11:
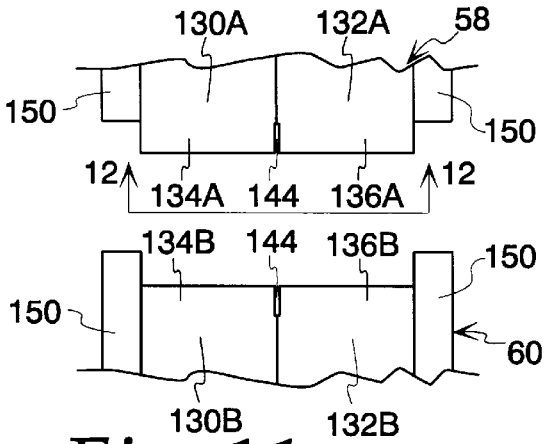
FIG. 11 is a diagrammatic illustration taken generally along the line 11—11 in FIG. 5 showing the axial layout of a third pair of the roll dies, with the dies separated for purposes of illustration.
Figure 12:
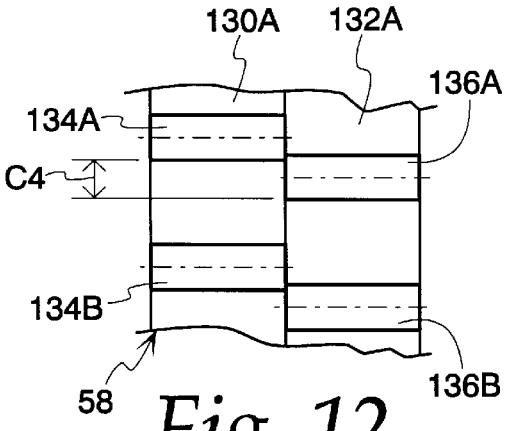
FIG. 12 is a diagrammatic illustration taken generally along the line 12—12 in FIG. 11 showing the circumferential arrangement of a plurality of disks that form one of the roll dies shown in FIG. 11.

As seen in FIG. 11, each of the roll dies 58, 60 is made up of two toothed roll die disks 130A, 132A and 130B, 132B, respectively, mounted for rotation together about the respective axes 70 and 72, with the disk 130A mating with the disk 130B, and the disk 132A mating with the disk 132B. Because the relative circumferential arrangement of the teeth of the roll die disks 130A and 132A is mirrored by the circumferential arrangement of the teeth of the disks 130B and 132B, only the circumferential arrangement of the teeth of the disks 130A, 132A need be described in detail. As seen in FIG. 12, the disk 130A has a plurality of teeth 134A that are offset by a circumferential distance C4 from a plurality of teeth 136A on the disk 132A. The disks 130B and 132B have teeth 134B and 136B, respectively, that mirror the teeth 134A and 136A, respectively, to extend into the tooth spaces between the teeth 134A and 136A, to mesh with the teeth 134A and 136A. When the strip 20 is passed through the mating roll dies 58 and 60, the teeth 134A and 134B cooperate to engage the row 22, as well as the optional rows 34A–34F, of the fin strip 36, while the teeth 136A and 136B engage the row 24, as well as the optional rows 34A–34F, of the fin strip 38.

Figure 13:
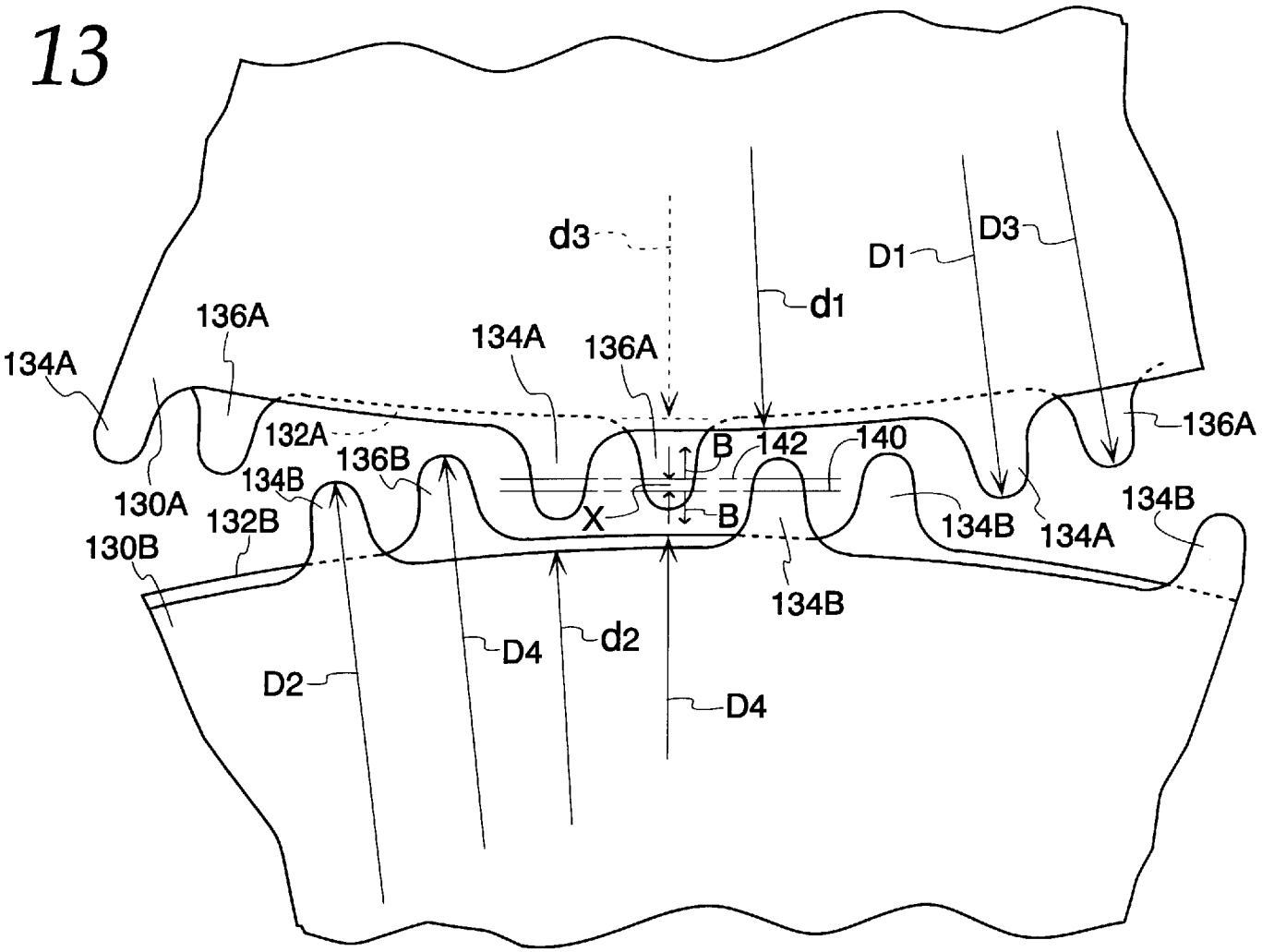
FIG. 13 is an enlarged fragmentary view of the area indicated by the line 13—13 in FIG. 5.

As seen in FIG. 13, the disk 130A has a major diameter D1 and a minor diameter d1, the disk 130B has a major diameter D2 and a minor diameter d2, the disk 132A has a major diameter D3 and a minor diameter d3, and the disk 132B has a major diameter D4 and a minor diameter d4.

As best seen in FIG. 11, preferably, the ends of each of the teeth 134A, 132A, 134B, 136B have reliefs 144 that extend across the entire end surface of the tooth. The reliefs 144 are incorporated to prevent the teeth 136A, 136B from engaging the row 22, and to prevent the teeth 134A, 134B from engaging in the row 24.

In one embodiment, the rotational timing between the roll dies 54, 56 at the second roll station 46 and the roll dies 58, 60 at the third roll station 48 is maintained so that the engagement of the teeth 134A, 1343, and 136A, 136B with the respective rows 22, 24 places the strip 20 in a sufficient amount of tension to displace the two rows 22, 24 relative to each other in a direction parallel to the length of the strip 20 thereby breaking the connections 30 to form the two fin strips 36 and 38 with the side edges 40 and 42 defined by the separated interface 32. The amount of tension required is dependent upon, at least in part, the thickness of the sheet material of the strip 20, the cross-sectional shear area of the connections 30, and the material properties of the strip 20. Preferably, in this embodiment, the major diameters D1, D2, D3 and D4 are all equal to each other and the minor diameters d1, d2, d3 and d4 are all equal to each other.

In another embodiment, the major diameter D2 of the disk 130B is less than the major diameter D1 of the disk 130A, the minor diameter d2 of the disk 130B is less than the minor diameter d1 of the disk 130A, the major diameter D3 of the disk 132A is less than D1, and the minor diameter d3 of the disk 132A is less than d1. According to one version of this embodiment, a major diameter D4 of the disk 132B is greater than D3, and the minor diameter d4 of the disk 132B is greater than d3. According to another version, D4 is nominally equal to D3, and d4 is nominally equal to d3. According to one highly preferred version, D1 is nominally equal to D4, d1 is nominally equal to d4, D2 is nominally equal to D3, and d2 is nominally equal to d3. As previously noted, the teeth 134A and 134B engage the row 22, while the teeth 136A and 136B engage the row 24. Either alone or together, the differences in the major diameters D1 –D4 and/or the differences in the minor diameters d1 –d4 of the disks 130A, 130B, 132A, 132B, allow the disks 130A and 130B to force the row 22 along a first path, illustrated by dashed line 140 in FIG. 13, while the disks 132A and 132B force the row 24 along a second path, illustrated by the dashed line 142 in FIG. 13, that is displaced from the first path by a distance X in the displacement direction, illustrated by arrows B, that is preferably mutually transverse to both the length L and the width W of the strip 20. The relative displacement X of the paths 140 and 142 of the two rows 22 and 24 breaks the connections 30, thereby forming the two fin strips 36 and 38 with the side edges 40 and 42 defined by the separated interface 32. The magnitude of the relative displacement X is dependent upon, at least in part, the thickness of the sheet material of the strip 20, the cross-sectional shear area of the connections 30, and the material properties of the strip 20. For example, in one preferred embodiment, X is nominally equal to 0.010" for a strip 20 of aluminum brazing sheet material having a thickness of 0.012 inches, and connections 30 having cross-sectional shear areas approximately equal to $7.2\times10^{-2}$ sq. inches.

Figure 14:
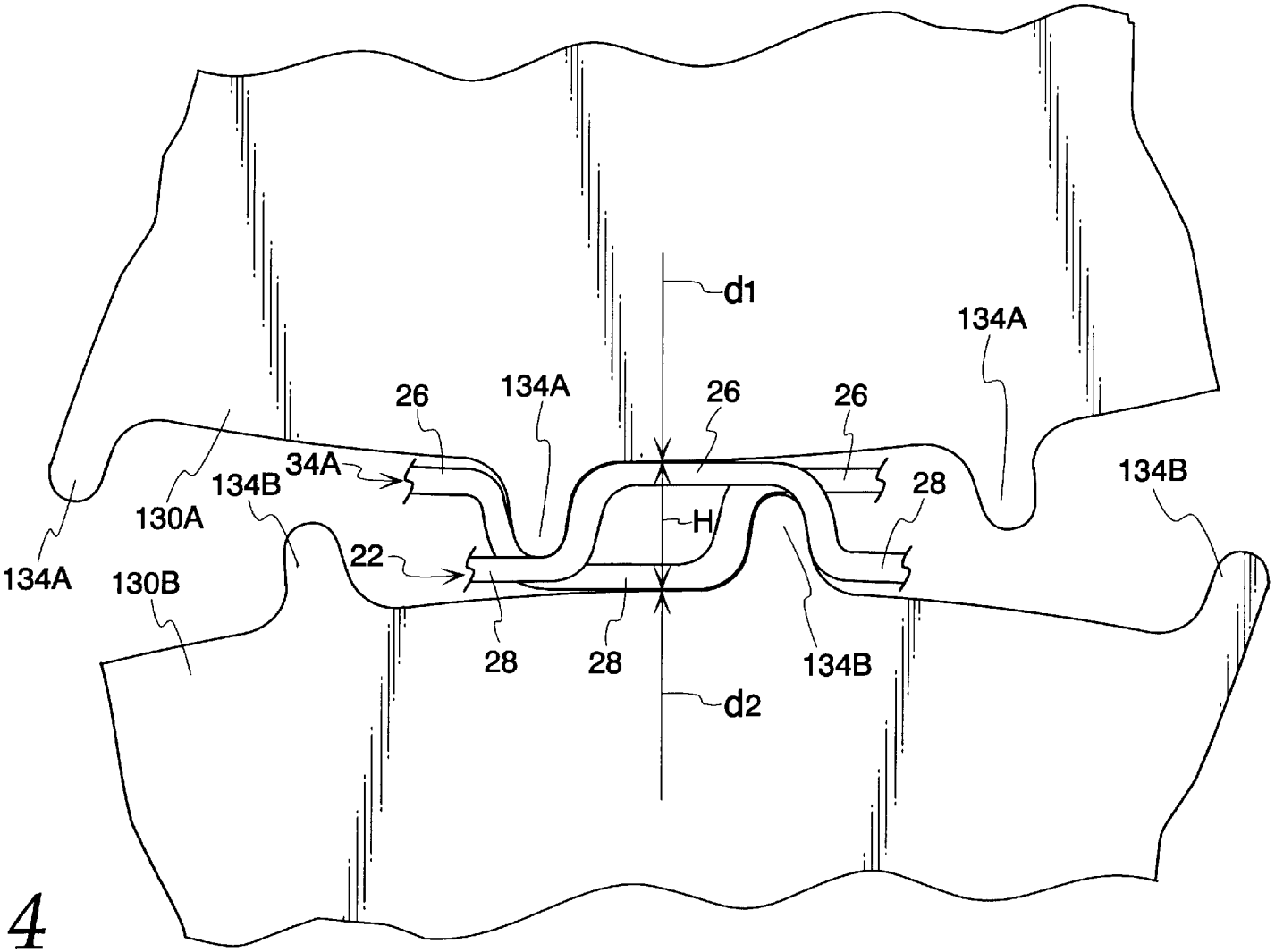
FIG. 14 is a view similar to FIG. 13 and including a fragmentary illustration of the elongated strip of sheet material shown in FIG. 1.

In one preferred embodiment, the roll dies 58 and 60 are also used to form the final height H of the fin strips 36, 38 transverse to both the length L and the width W. Because the interaction of each mating pair of disks is the same, this function will be described only with respect to disks 130A and 130B. As seen in FIG. 14, the minor diameters d1, d2 of the disks 130A and 130B engage the crests 26 and valleys 28 across the width of the fin strip 36 parallel to the axes 70, 72 and compress the fin strip 36 to the desired height H. This result can be achieved, at least in part, by reducing the spacing PD3 in comparison to the spacing PD2.

Additionally, in one preferred embodiment, the roll dies 58 and 50 are also used to more accurately define the pitch between each of the crests 26 and each of the valleys 28.

As seen in FIGS. 6, 9, and 11, each of the roll dies 50, 52, 54, 56, 58 and 60 includes a pair of end disks 150 spaced on opposite ends of the die. The end disks 150 of the dies 52, 56, and 60 have circular outer diameters that are greater than the major diameter of the toothed disks on the die, while the end disks 150 on the dies 50, 54, and 58 have circular outer diameters that are less than, or equal to, the minor diameter of the teeth on the disks of their respective dies. This allows the end disks 150 to retain the strip 20 across the face widths of each of their respective mating dies 50–52, 54–56, and 58–60, as the strip 20 passes through each of the mating dies.

Figure 15:
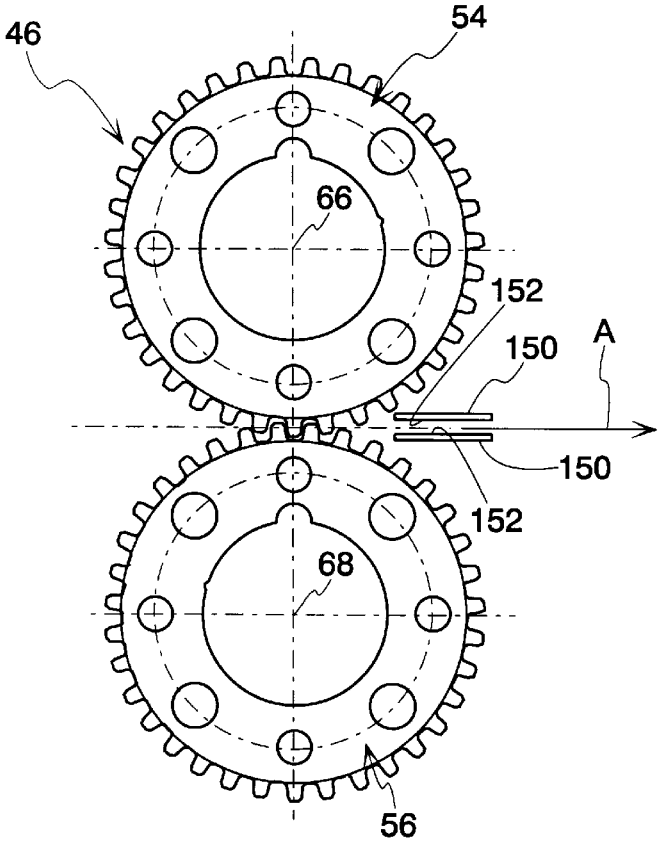
FIG. 15 is a diagrammatic representation of one of the forming stations shown in FIG. 5.

As seen in FIG. 15, it is preferred that a pair of stripper bars 150 be mounted with a fixed relationship to the exit side of the meshing roll dies 54, 56. The stripper bars 150 are mounted on opposite sides of the path of the strip 20, indicated by arrow A, as it moves from the second station 46 to the third station 48, with surfaces 152 that extend parallel to the length L and width W of the strip 20. The stripper bars 150 aid in separating the strip 20 from the roll dies 54 and 56. Preferably, similar stripper bars 150 are provided at the exit side of the meshing dies 50, 52 of the first station 44 and the exit side of the meshing dies 58, 60 of the third station 48. Additionally, similarly configured and arranged guide bars (not shown) can be provided at the entrance side of each of the mating roll dies 50–52, 54–45 and 58–60 to guide the strip into each of the meshing dies.

For some configurations of fin strips, it is preferred that the circumferential offsets C1, C2, and C4 all be equal to each other. However, in other configurations of fin strips, this may not be a requirement. The offsets C1, C2, and C4 are dependent at least in part on the material gauge and type.

Figures 16, 17, 18:
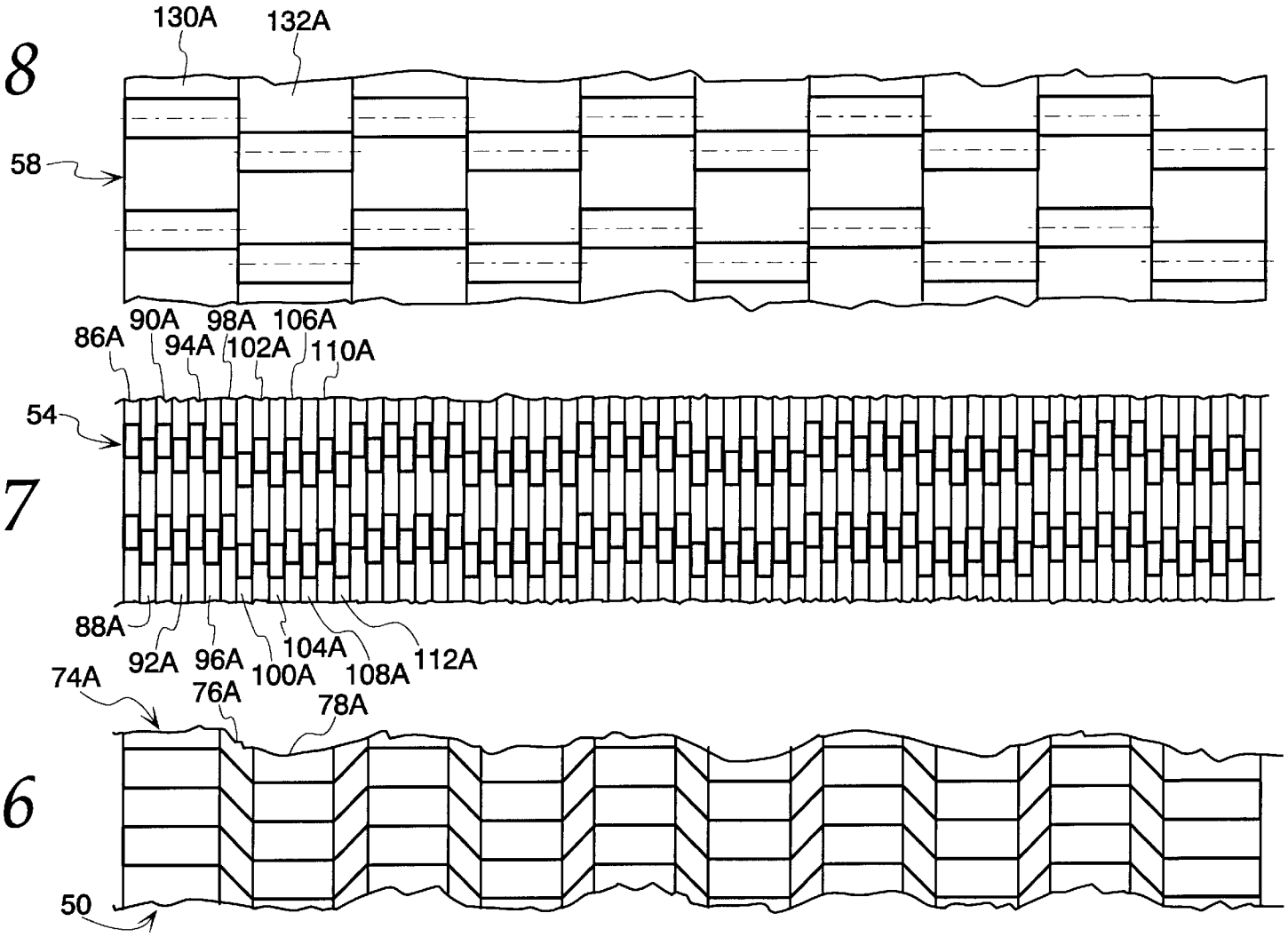
FIG. 16 is a view similar to FIG. 7, but showing the circumferential arrangement of disks for forming 10 fin strips from a single elongated strip of sheet material.
FIG. 17 is a view similar to FIG. 10, but showing the circumferential arrangement of disks for forming 10 fin strips from a single elongated strip of sheet material in cooperation with the arrangement shown in FIG. 16.
FIG. 18 is a view similar to FIG. 12, but showing the circumferential arrangement of disks for forming 10 fin strips from a single elongated strip of sheet material in cooperation with the arrangement shown in FIGS. 16 and 17.

While the invention has been described with respect to the strip of material 20 that is formed into the two separate fin strips 36 and 38, it should be understood that the roll dies 50–60 can be modified to provide any number of individual fin strips from a single strip 20 of sheet material by simply repeating the offsetting patterns of the individual disks 74A–78A, 74B–78B, 86A–112A, 86B–112B, 130A–132A, and 130B–132B described above. For example, as seen in FIGS. 16–18, the roll dies 50–60 are shown diagrammatically with their disks configured to produce 10 individual fin strips from a single strip 20 of sheet material. In this regard, it should be noted that any of the disks 74A, 78A, 74B, and 78B that are located between two of the disks 84A or 84B, respectively, must have a width parallel to the axes 62 and 64 that is reduced by one-half of the width of one of the disks 76A, 76B, to accommodate the additional disks 76A, 76B.

It will be appreciated that invention allows for the forming of a plurality of fin strips 10 from a width of sheet material 20 without requiring sheet stock that is pre-slit. Further, the invention allows for multiple fin strips 10 to be formed simultaneously in a roll forming machine, without requiring the extensive set-up time associated with threading individual fin strips through the roll forming stations.

What is claimed is:

1. A pair of mating roll dies for forming a plurality of fin strips from a single elongated strip of sheet material, the strip of sheet material including a pair of adjacent, longitudinal rows of alternating crests and valleys, the crests and valleys of one row of said pair longitudinally offset from the crests and valleys of the other row of said pair so that the two rows are joined by a plurality of longitudinally spaced, discrete connections, the roll dies comprising:

a first toothed disk having a major diameter D1 and a minor diameter d1, the first toothed disk mounted on one of the roll dies for rotation therewith about a first axis with the teeth of the first disk arranged to engage one of said two rows of alternating crests and valleys;

a second toothed disk having a major diameter D2 that is less than D1 and a minor diameter d2 that is less than d1, the second toothed disk mounted on the other of the roll dies for rotation therewith about a second axis with the teeth of the second disk arranged to engage said one of said two rows;

a third toothed disk having a major diameter D3 that is less than D1 and a minor diameter d3 that is less than d1, the third toothed disk mounted adjacent the first toothed disk on said one of the roll dies for rotation therewith about the first axis with the teeth of the third disk arranged to engage the other of said two rows; and a fourth toothed disk having a major diameter D4 and a minor diameter d4, the fourth toothed disk mounted adjacent the second toothed disk on said other of the roll dies for rotation therewith about the second axis with the teeth of the fourth disk arranged to engage said other of said two rows.

2. The roll dies of claim 1 wherein D4 is greater than D3, and d4 is greater than d3.

3. The roll dies of claim 1 wherein D4 is nominally equal to D3, and d4 is nominally equal to d3.

4. The roll dies of claim 1 wherein D1 is nominally equal to D4, d1 is nominally equal to d4, D2 is nominally equal to D3, and d2 is nominally equal to d3.

5. A pair of mating roll dies for forming a plurality of fin strips from a single elongated strip of sheet material, the strip of sheet material including a pair of adjacent, longitudinal rows of alternating crests and valleys, the crests and valleys of one row of said pair longitudinally offset from the crests and valleys of the other row of said pair so that the two rows are joined by a plurality of longitudinally spaced, discrete connections, the roll dies comprising:

a first toothed disk having a major diameter D1 and a minor diameter d1, the first toothed disk mounted on one of the roll dies for rotation therewith about a first axis with the teeth of the first disk arranged to engage one of said two rows of alternating crests and valleys;

a second toothed disk having a major diameter D2 and a minor diameter d2, with at least one of D2 and d2 being less than D1 or d1, respectively, the second toothed disk mounted on the other of the roll dies for rotation therewith about a second axis with the teeth of the second disk arranged to engage said one of said two rows;

a third toothed disk having a major diameter D3 and a minor diameter d3, with at least one of D3 and d3 being less than D1 or d1, respectively, the third toothed disk mounted adjacent the first toothed disk on said one of the roll dies for rotation therewith about the first axis with the teeth of the third disk arranged to engage the other of said two rows; and a fourth toothed disk having a major diameter D4 and a minor diameter d4, the fourth toothed disk mounted arranged the second toothed disk on said other of the roll dies for rotation therewith about the second axis with the teeth of the fourth disk adapted to engage said other of said two rows.

6. A method of roll forming a plurality of fin strips from a single elongated strip of sheet material, the method comprising the steps of:

providing an elongated strip of sheet material having a length and a transverse width;

roll forming a pair of adjacent, longitudinal rows of alternating crests and valleys in the elongated strip of sheet material, the crests and valleys of one row of said pair longitudinally offset from the crests and valleys of the other row of said pair so that the two rows are joined by a plurality of longitudinally spaced, discrete connections that define a longitudinal interface between the two rows; and breaking the connections by displacing the two rows relative to each other to form a pair of fin strips each strip having a side edge defined by the separated interface.

7. The method of claim 6 wherein the breaking step comprises breaking the connections by displacing the two rows relative to each other in a direction that is nonparallel to both the length and the transverse width.

8. The method of claim 6 wherein the breaking step comprises breaking the connections by displacing the two rows relative to each other in a direction that is substantially parallel to the length of the strip.

9. The method of claim 6 wherein the roll forming step further comprises roll forming additional longitudinal rows of alternating crests and valleys to each side of the pair of adjacent, longitudinal rows of alternating crests and valleys in the elongated strip of sheet material, the crests and valleys of each said additional row offset from the crests and valleys of any adjacent row.

10. The method of claim 7 wherein the direction of displacement is mutually transverse to both the length and the transverse width.

11. The method of claim 7 wherein the breaking step further comprises:

providing two pairs of mating roll die disks, each pair having one disk mounted for rotation about a first axis and the other disk mounted for rotation about a second axis, one of the pairs engaging one of the two rows of alternating crests and valleys and forcing the one row along a first path, the other of the pairs engaging the other of said two rows and forcing the other row along a second path that is displaced from the first path in said displacement direction.

12. The method of claim 7 wherein the breaking step further comprises deforming the crests and valleys of each of the fin strips to establish a finished height for each of the fin strips that is mutually transverse to the length and transverse width.

13. The method of claim 8 wherein the breaking step further comprises engaging the crests and valleys of the strip at a first location along the length of the strip with a first pair of mating roll dies;

engaging the crests and valleys of the elongated strip at a second location along the length of the strip with a second pair of mating roll dies, the second location spaced from the first location along the length of the strip; and placing the elongated strip in tension between the first and second pairs of mating roll dies to displace the two rows relative to each other in the direction that is substantially parallel to the length of the strip to break the connections.

* * * * *